US011287111B2

(12) United States Patent
Warner et al.

(10) Patent No.: US 11,287,111 B2
(45) Date of Patent: Mar. 29, 2022

(54) SPRING LOADED LENS RETAINERS

(71) Applicant: SIGNIFY HOLDING B.V., Eindhoven (NL)

(72) Inventors: Christopher Patrick Warner, Eindhoven (NL); Carlton Bruce Plunk, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/041,219

(22) PCT Filed: Apr. 2, 2019

(86) PCT No.: PCT/EP2019/058257

§ 371 (c)(1),
(2) Date: Sep. 24, 2020

(87) PCT Pub. No.: WO2019/192994

PCT Pub. Date: Oct. 10, 2019

(65) Prior Publication Data

US 2021/0199269 A1 Jul. 1, 2021

Related U.S. Application Data

(60) Provisional application No. 62/652,983, filed on Apr. 5, 2018.

(30) Foreign Application Priority Data

Apr. 12, 2018 (EP) ..... 18167011

(51) Int. Cl.
*F21V 17/00* (2006.01)
*F21V 17/16* (2006.01)
(Continued)

(52) U.S. Cl.
CPC ..... *F21V 17/16* (2013.01); *F21V 5/04* (2013.01); *F21Y 2103/10* (2016.08); *F21Y 2115/10* (2016.08)

(58) Field of Classification Search
CPC ..... F21V 7/16; F21V 5/00; F21V 3/00; F21V 5/04; F21S 8/00; F21Y 2103/10; F21Y 2115/10; G02B 7/026
See application file for complete search history.

(56) References Cited

U.S. PATENT DOCUMENTS

2018/0224075 A1* 8/2018 Wilcox ..... F21V 5/04
2018/0274734 A1* 9/2018 Cerce ..... F21S 8/00

FOREIGN PATENT DOCUMENTS

CN 204300890 U 4/2015
CN 204730047 U 10/2015
(Continued)

*Primary Examiner* — Y M. Quach Lee
(74) *Attorney, Agent, or Firm* — Daniel J. Piotrowski

(57) ABSTRACT

A luminaire includes a body, with first and second surfaces that define an elongate interior cavity between the first and second surfaces, the elongate interior cavity being sized to receive one or more elongate light sources; an elongate lens that is removably securable to the body to at least partially cover the elongate interior cavity; and at least one lens retainer disposed at a first end of the elongate interior cavity, where the lens retainer includes a frame including a first frame end and a second frame end, at least a first spring lever disposed between the first and second frame ends, where the at least first spring lever is biased towards a second end of the elongate interior cavity that is opposite the first end of the elongate interior cavity; where the elongate lens is snugly retainable on the body using the bias provided by the spring lever.

13 Claims, 6 Drawing Sheets

(51) Int. Cl.

| | |
|---|---|
| ***F21V 5/04*** | (2006.01) |
| *F21Y 103/10* | (2016.01) |
| *F21Y 115/10* | (2016.01) |

(56) References Cited

FOREIGN PATENT DOCUMENTS

| | | | |
|---|---|---|---|
| DE | 102007044964 | A1 | 4/2009 |
| DE | 102008033743 | A1 | 4/2010 |
| GB | 2475613 | A | 5/2011 |

* cited by examiner

SPRING LOADED LENS RETAINERS

CROSS-REFERENCE TO PRIOR APPLICATIONS

This application is the U.S. National Phase application under 35 U.S.C. § 371 of International Application No. PCT/EP2019/058257, filed on Apr. 2, 2019, which claims the benefits of European Patent Application No. 18167011.8, filed on Apr. 12, 2018 and U.S. Patent Application No. 62/652,983, filed on Apr. 5, 2018. These applications are hereby incorporated by reference herein.

TECHNICAL FIELD

The present disclosure is directed generally to luminaires and light fixtures. More particularly, various inventive apparatus disclosed herein relate to use of a lens retainer apparatus for retaining an elongated lens within a luminaire.

BACKGROUND

Conventionally, linear luminaires have a center lens that may shield a linear (e.g. elongate) light source such as a fluorescent tube or tubular light emitting diode (TLED). Such a lens may need to be removed occasionally in order to access the linear light source. Traditionally, this removal is accomplished by shifting the lens to one end of the luminaire, which results in the opposing end of the lens coming free of the luminaire, and thus being removable.

Often, these lens are only held in place at each end of the luminaire, which creates an opportunity for the lens to shift out of position and fall from the luminaire. There are numerous reasons that a lens may shift out of position including, but not limited to improper installation and/or the installed lens being too short or out of the range of tolerance. Additionally, it is known that a lens may physically shrink in size when exposed to low temperatures; in such instances, the lens may fall below the specified dimension for the luminaire. Regardless of the reason, a lens falling from the luminaire is undesirable as it may cause property damage and/or bodily harm to any person(s) below it. Therefore, an apparatus configured to securely hold a lens in place, thus minimizing the likelihood a lens may become dislodged and fall, is desired in the art.

SUMMARY

In one aspect, a luminaire is disclosed, where the luminaire includes: a body, with first and second surfaces defining an elongate interior cavity between the first and second surfaces, the elongate interior cavity sized to receive one or more elongate light sources; an elongate lens that is removably securable to the body to at least partially cover the elongate interior cavity; and at least one lens retainer disposed at a first end of the elongate interior cavity, where the lens retainer includes: a frame including a first frame end and a second frame end, at least a first spring lever disposed between the first and second frame ends, where the at least first spring lever is biased towards a second end of the elongate interior cavity that is opposite the first end of the elongate interior cavity; where the elongate lens is snugly retainable on the body using the bias provided by the spring lever.

In some embodiments, the luminaire also includes a driver for receiving an alternating current (AC) input and providing a direct current (DC) output for the elongate light source.

In some embodiments, the frame has a semi-circular shape. In some embodiments, the lens retainer also includes an interior perimeter surface facing the elongate interior cavity, where the interior perimeter surface extends further into the elongate interior cavity at the first frame end and the second frame ends. In other embodiments, the interior perimeter surface is extended further into the elongate interior cavity at the first and the second frame ends by about one quarter inch.

In some embodiments, the luminaire also includes a second lens retainer disposed at the second end of the elongate interior cavity, where the second lens retainer includes: a frame including a first frame end and a second frame end, and at least a first spring lever disposed between the first and second frame ends, where the at least first spring lever is biased towards the first end of the elongate interior cavity. In other embodiments, both the at least one lens retainer and the second lens retainer each further include an interior perimeter surface facing the elongate interior cavity, where the interior perimeter surface extends further into the elongate interior cavity at the first frame end and the second frame ends. In still other embodiments, the interior perimeter surfaces of the at least one lens retainer and the second lens retainer extend further into the elongate interior cavity at the first frame end and the second frame ends by about one quarter inch.

In some embodiments, each of the first and the second frame end also include a flat, substantial triangular-shaped end piece. In other embodiments, the at least one lens retainer further includes a spring clip protruding along an axis that divides the lens retainer in half at a midpoint of the frame between the first and second frame ends, wherein the spring clip is configured to couple with a corresponding receiving portion of a luminaire.

In some embodiments, the at least one lens retainer is opaque. In other embodiments, the at least one lens retainer is an acrylonitrile butadiene styrene plastic.

In some embodiments, the first frame end and the second frame end hold the lens retainer and the elongate lens to the luminaire using the first and the second surfaces and an end plate of the luminaire, where the first and second surfaces are sloped.

In another aspect, another luminaire is disclosed. Such a luminaire includes: a body, with a first and second surfaces that define an elongate interior cavity between the first and second surfaces, the elongate interior cavity being sized to receive one or more elongate light sources; an elongate lens that is removably securable to the body to at least partially cover the elongate interior cavity; and a first lens retainer disposed at a first end of the elongate interior cavity where the first lens retainer includes: a first lens retainer frame including a first frame end and a second frame end, a first and a second spring lever each disposed between the first and second frame ends of the first lens retainer, where the first and the second spring levers are biased towards a second end of the elongate interior cavity that is opposite the first end of the elongate interior cavity; a second lens retainer disposed at the second end of the elongate interior cavity where the second lens retainer includes: a second lens retainer frame including a first frame end and a second frame end, a third and a fourth spring lever each disposed between the first and second frame ends of the second lens retainer frame, where the first and the second spring levers are biased towards a second end of the elongate interior cavity that is opposite the first end of the elongate interior cavity; where the elongate lens is snugly retainable on the body using the bias provided by the first, second, third, and fourth spring levers.

In some embodiments, each of the first the second lens retainers further include an interior perimeter surface facing the elongate interior cavity, where the interior perimeter surface extends further into the elongate interior cavity at the first and second frame ends. In other embodiments, the interior perimeter surfaces of the first and the second lens retainers extend further into the elongate interior cavity at the first frame end and the second frame ends by about one quarter inch.

In yet another aspect, a lens retainer configured for use in a luminaire is disclosure, where the lens retain includes: a frame with a first frame end and a second frame end; a first and a second spring lever each disposed between the first and second frame ends, where the first and the second spring levers are biased towards an elongate interior cavity of the luminaire; and where the lens retainer is configured to snugly retain an elongate lens of the luminaire using the bias provided by the first and second spring levers.

The term "light source" should be understood to refer to any one or more of a variety of radiation sources, including, but not limited to, LED-based sources, incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the area or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The terms "luminaire" and "lighting fixture" is used herein to refer to an implementation or arrangement of one or more light sources and/or other components in a particular form factor, assembly, or package. A luminaire may include one or more light sources of same or different types. A given luminaire may have any one of a variety of mounting arrangements for the light source(s), enclosure/housing arrangements and shapes, and/or electrical and mechanical connection configurations. Additionally, a given luminaire optionally may be associated with (e.g., include, be coupled to and/or packaged together with) various other components (e.g., control circuitry) relating to the operation of the light source(s). An "LED-based luminaire" refers to a luminaire that includes one or more LED-based light sources as discussed above, alone or in combination with other non LED-based light sources. A "multi-channel" luminaire refers to an LED-based or non LED-based luminaire that includes at least two light sources configured to respectively generate different spectrums of radiation, wherein each different source spectrum may be referred to as a "channel" of the multi-channel luminaire.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally, but not exclusively, refer to the same parts throughout the different views. Also, the drawings are not necessarily to scale, emphasis instead generally being placed upon illustrating the principles of the disclosure.

FIG. 1A illustrates the example luminaire without an elongate lens; FIG. 1B illustrates the example luminaire with an elongate lens.

DETAILED DESCRIPTION

Figure 1A:
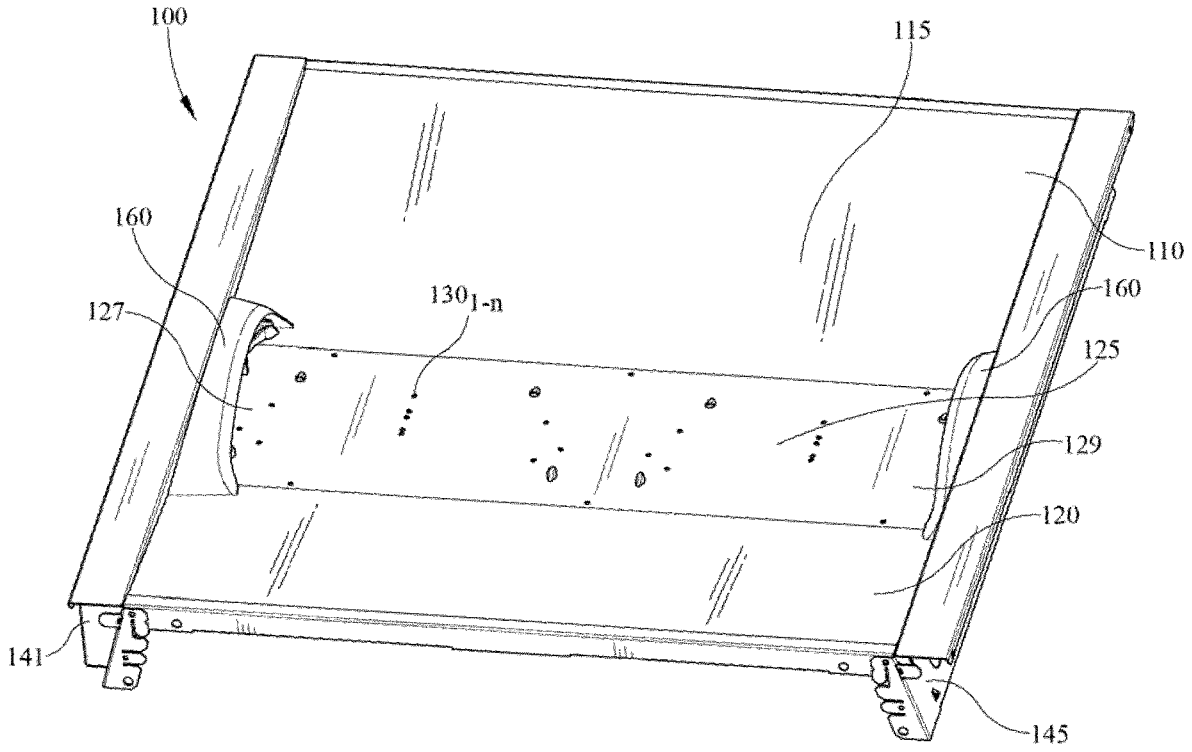
FIGS. 1A and 1B illustrate an example luminaire in accordance with various embodiments described herein.
Figure 1B:
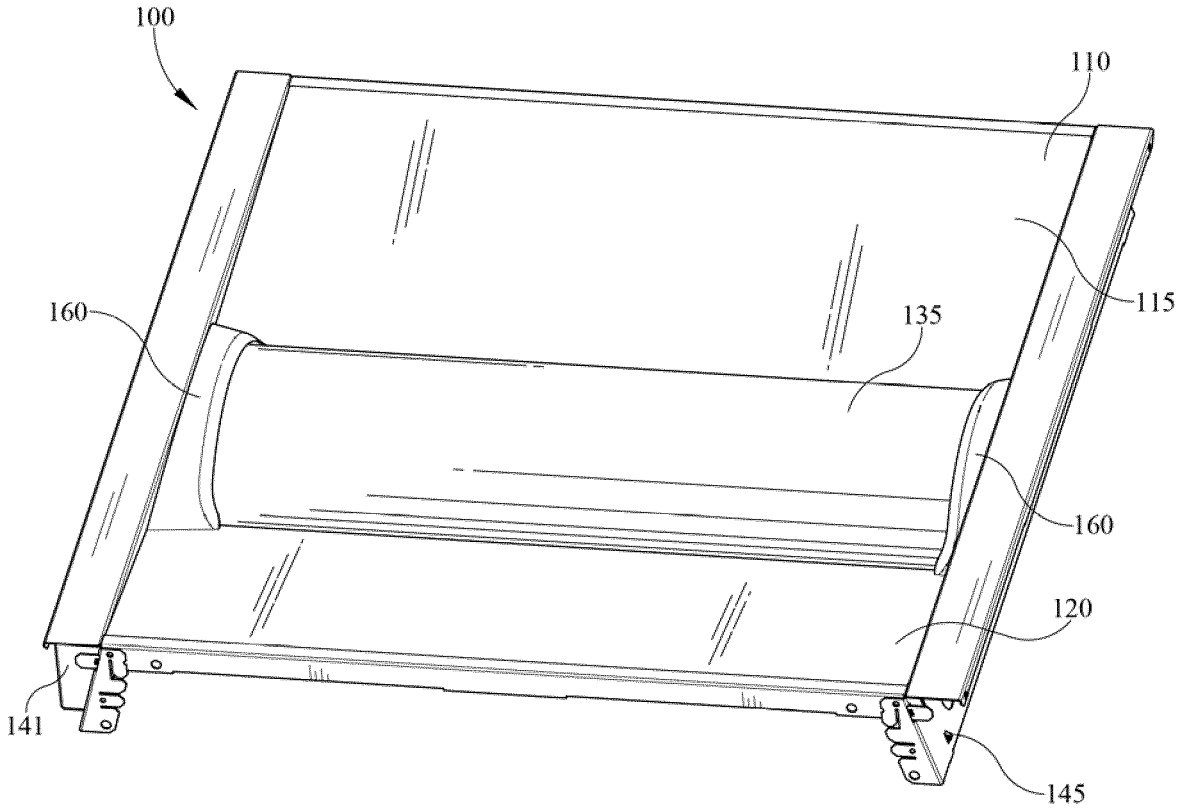
Figure 2:
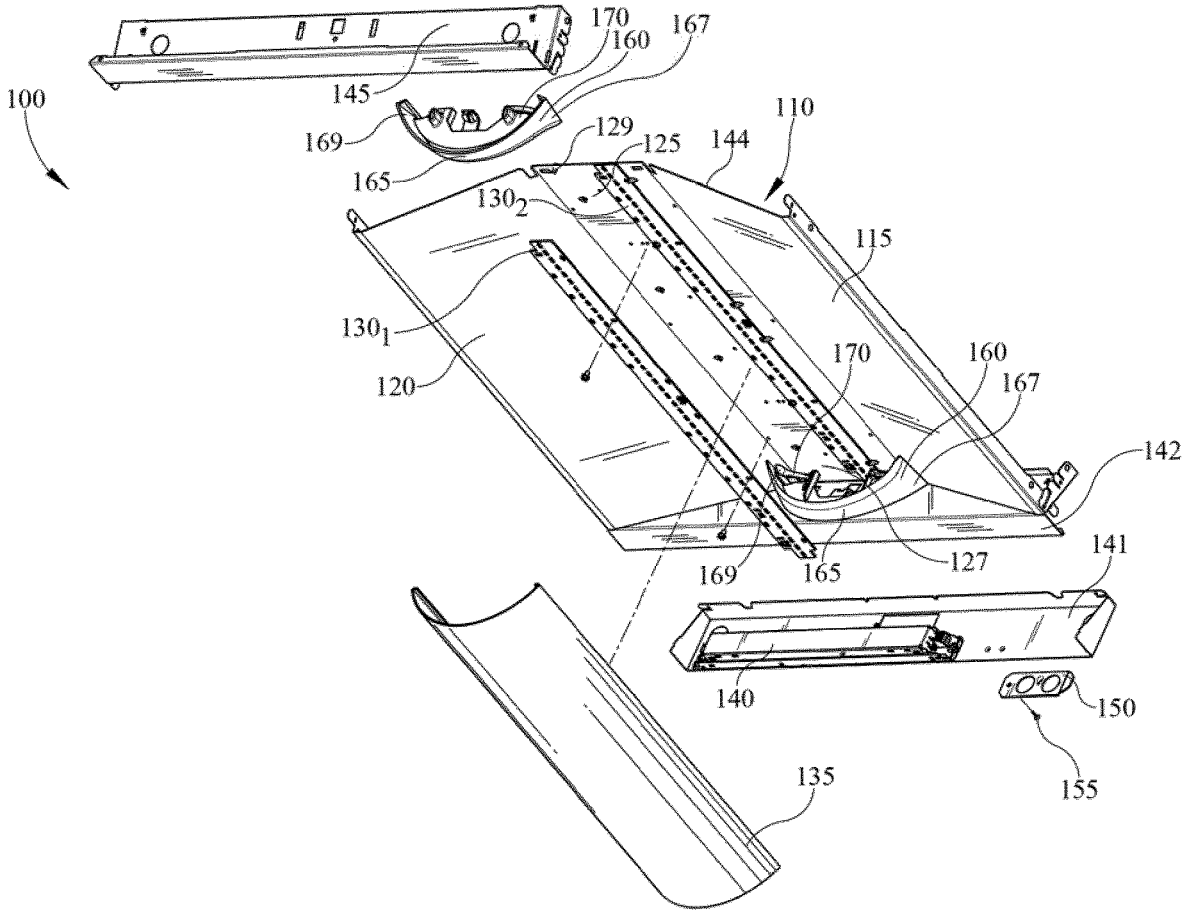
FIG. 2 is an exploded view of the example luminaire of FIGS. 1A and 1B in accordance with various embodiments described herein.

FIGS. 1A-B illustrate an example luminaire 100 consistent with the embodiments described, and FIG. 2 illustrates an exploded view of the luminaire of FIGS. 1A-B. FIG. 1A illustrates the luminaire 100 with the elongate lens 135 removed, while FIG. 1B illustrates the luminaire 100 with the elongate lens 135 in place. The luminaire 100 may include a body 110. The body 110 of the luminaire may include a first surface 115 and second surface 120 that define an elongate interior cavity 125 between them. The elongate interior cavity may further include a first end 127 and a second end 129. In some embodiments, the first and second surfaces 115, 120 may further include one or more reflective panels that slope downward (e.g. when the luminaire 100 is ceiling mounted) in order to reflect the light emitted by the light source incident on these surfaces. The elongate interior cavity 125 may be sized so as to receive one or more elongate light sources $\mathbf{130}_{1\text{-}N}$, as shown in FIG. 2. The embodiment illustrated in FIG. 2 utilizes elongated LED boards as the light source(s) $130_{1-N}$; however, this is not intended to be limiting as, other forms of light sources may be utilized including, but not limited to incandescent, halogen, fluorescent, and so forth. It is also to be understood that there may be multiple light sources within a single luminaire, and that they may homogenous or heterogeneous (e.g., LED and incandescent).

Referring specifically to FIG. 1B, the luminaire 100 may also include an elongate lens 135 that may cover at least a portion of the elongate interior cavity 125 and the one or more light sources $130_{1-N}$ contained therein. The elongate lens 135 may be removably secured to the body 110 of the luminaire 100. In some instances, such removability may be desired so that the one or more light source $130_{1-N}$ (e.g. LEDs) may be accessed for service, replacement, etc. This elongate lens 135 may be used in order to collect and focus the light being emitted from the one or more light sources $130_{1-N}$, thus improving the overall lighting experience. Furthermore, the elongate lens 135 may be a plano-convex lens, such as illustrated in FIG. 1B, or other types of lens 135 may be used, such as, bi-convex lens, aspheric type lens, or a combination of several types of lenses.

The term "elongate" does not limit the luminaire 100, the elongate interior cavity 125, the one or more elongate light sources $130_{1-N}$ included therein, and/or the elongate lens 135 to any one particular length. The length of the luminaire 100, the elongate interior cavity 125, the one or more elongate light sources $130_{1-N}$ included therein, and/or the elongate lens 135 may vary and still be "elongate".

Referring now specifically to FIG. 2, in some embodiments, the luminaire 100 may also include a driver 140 that receives an alternating current (AC) input and then provides a direct current (DC) output to the elongate light source $130_{1-N}$ (e.g. one or more LEDs) in order to power the one or more light sources $130_{1-N}$. In such embodiments, the driver 140 may be positioned on a first end plate 141 at a first end 142 of the luminaire body 110. In some embodiments, an opposing, second end 144 of the luminaire body 110 may include a second end plate 145. In other embodiments, the luminaire 100 may also include an access plate 150. Such an access plate 150 may be placed proximate the driver 140 in order to allow the supply connections to be made through the access plate 150. Furthermore, a grounding screw 155 may also be provided through the access plate 150.

The luminaire 100 may also include one or more lens retainers 160, illustrated in greater detail in FIGS. 3-5 and discussed in greater detail below. The lens retainer 160 may be disposed at the first end 127 and/or the second end 129 of the elongate interior cavity 125. In some embodiments, such as illustrated in FIGS. 1A-1B and 2, the luminaire 100 may include two lens retainers 160, with one at each the first end 127 and the second end 129 of the elongate interior cavity 125. Generally, each lens retainer 160 may include a frame 165 including a first frame end 167 and a second frame end 169. Each lens retainer 160 may further include one or more spring levers 170 disposed between the first and second frame ends 167, 169. In some embodiments, the lens retainer(s) 160 each have two spring levers 170, one proximate each end 167, 169 of the frame 165. Each spring 170 may be biased towards the opposing end of the elongate interior cavity 125; for example, if the lens retainer 160 is positioned at a first end 127 of the elongate interior cavity 125, the spring lever(s) will be biased towards the second end 129 of the elongate interior cavity 125. These one or more lens retainers 160 may function to retain the elongate lens 135 in the luminaire 100 by using the bias provided by the spring lever(s) 170 to provide pressure retention of the lens 135. In some embodiments, when installed the elongate lens 135 may be flush against the lens retainer 160, so that there is no gap between the lens 135 and the retainer(s) 160.

If the lens 135 requires removal, for example for servicing of the one or more light sources $130_{1-N}$, a user may slide the lens 135 toward an end of the luminaire 100. In embodiments, with two lens retainers 160 the lens 135 may be slide in to either end; in embodiments with only one lens retainer 160, the lens may be slid to the end of the luminaire 100 with the lens retainer 160. By sliding the lens 135 towards a lens retainer 160, the spring(s) 170 of the lens retainer 160 will be displaced allowing the lens 135 to become free at the opposing end of the luminaire 100.

The luminaire 100 may have any one of a variety of mounting arrangements for the light source(s), enclosure/housing arrangements and shapes, and/or electrical and mechanical connection configurations known in the art. Furthermore, although not specifically described herein the luminaire 100 may optionally be associated with any number of various other components (e.g., wired or wireless control circuitry) relating to the operation of the light source(s).

Figure 3:
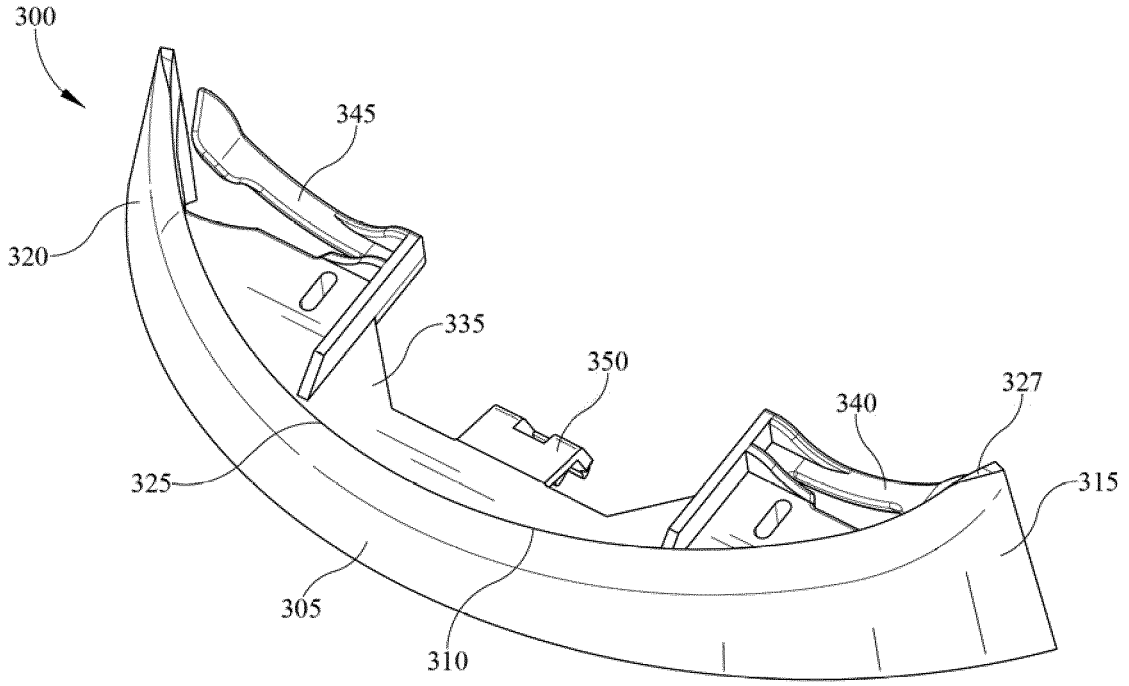
FIG. 3 is a perspective view of an example lens retainer in accordance with various embodiments described herein.
Figure 4:
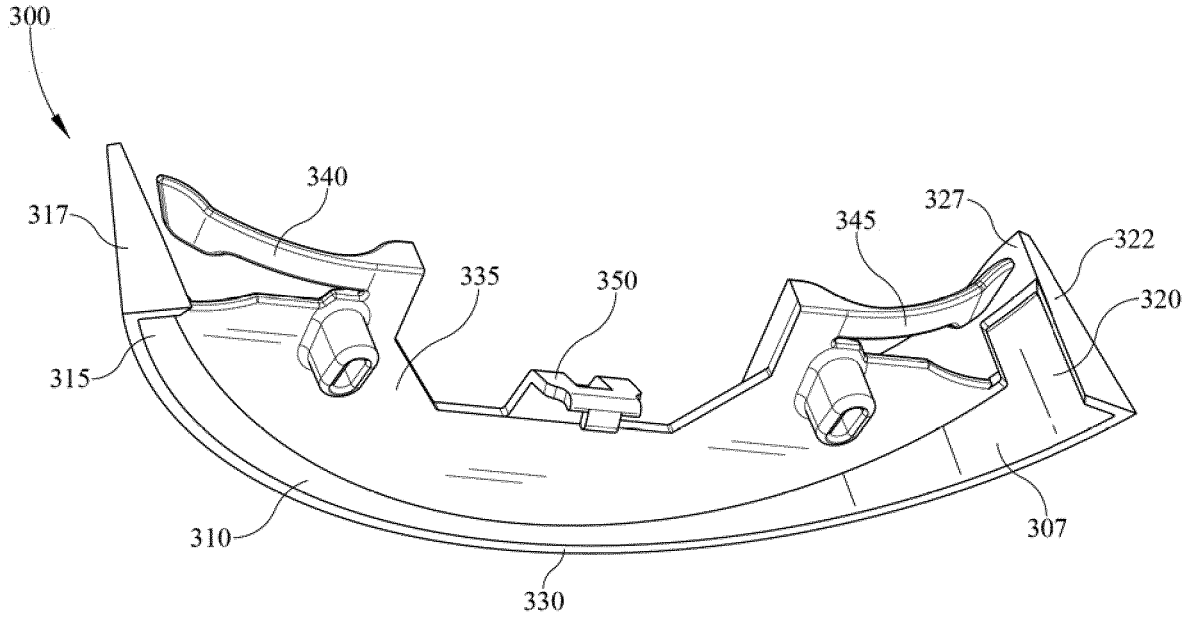
FIG. 4 is a back view of the lens retainer of FIG. 3 in accordance with various embodiments described herein.
Figure 5:
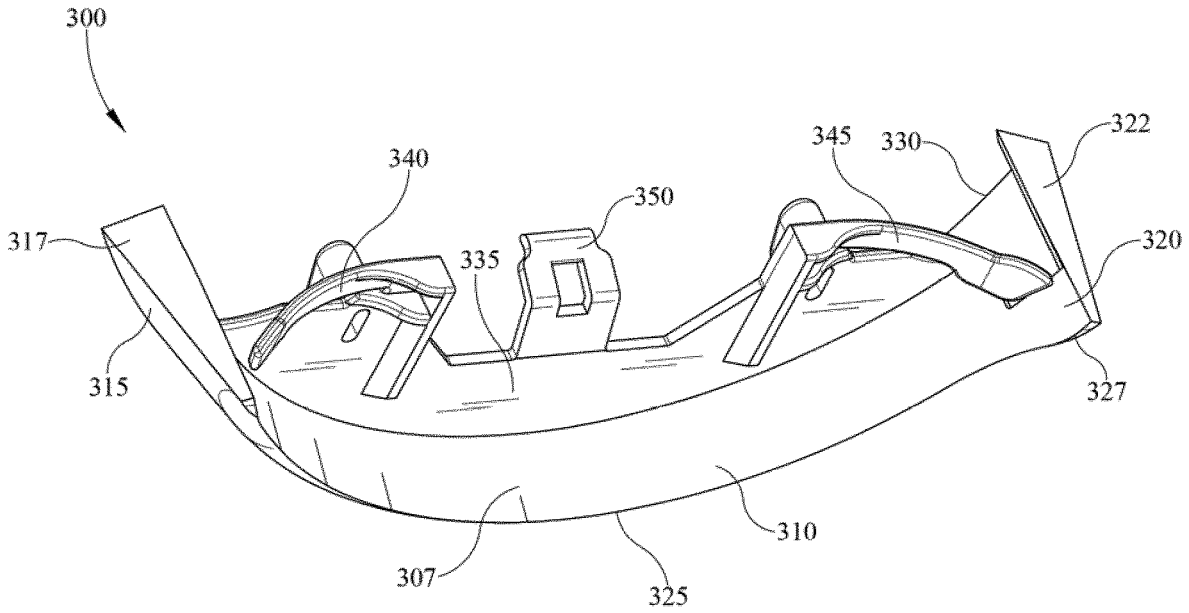
FIG. 5 is a front view of the lens retainer of FIG. 3 in accordance with various embodiments described herein.

Referring now to FIGS. 3-5, an exemplary embodiment of a lens retainer 300 will be described in greater detail. FIG. 3 illustrates a perspective view of the lens retainer 300, where a front face 305 of the frame 310 is visible. The front face 305 may be the portion of the lens retainer 300 visible once the lens (not illustrated in FIGS. 3-5) is installed; therefore, in some embodiments, the front face 305 of the lens retainer 300 may be colored in order to match and/or coordinate with the color of the luminaire. The frame 310 of lens retainer 300 may also contain a rear face 307, on an opposing side of the frame 310 from the front face 305, which would not be visible when the lens is installed.

The frame 310 of the lens retainer 300 may also include a first end 315 and a second end 320. In some embodiments, each end 315, 320 may further include an end cap or a substantially flat portion 317, 322, respectively (see FIG. 4). Each end cap or flat portion 317, 322 may be shaped and configured so as to lay flush with the first and second surfaces of the luminaire body, described above with reference to 115 and 120 of FIGS. 1A-1B and 2. In some embodiments, the flat portions 317, 322 may be fully flat or without any slope. Additionally, in some embodiments, these flat portions 317, 322 may generally be the shape of triangle, such as illustrated in FIGS. 4 and 5; however, this is not intended to be limiting, as the flat portion may be a rectangular shape, or any other desired shape.

In some instances, the frame 310 may further include an interior perimeter edge or surface 325 (see FIGS. 3 and 5) and an exterior perimeter edge or surface 330 (see FIGS. 4 and 5). The exterior perimeter surface 330 may be proximate an end plate (e.g. 141, 145) of the luminaire when installed, while the interior perimeter surface 325 may be proximate the elongate interior cavity and lens when installed. In some embodiments, the interior perimeter surface 325 may further include one or more extension portions 327 that extend from first frame end 315 and/or the second frame ends 320 further into the elongate interior cavity when installed. In some embodiments, these extension portions 327 may extend an additional ¼ inch beyond the remainder of interior perimeter surface 325. In some instances, the one or more extension portions 327 are molded as part of the lens retainer 300 itself; although this is not intended to be limiting, in other instances the extension portion 327 may be separate pieces that is affixed to the interior perimeter surface 325 of the lens retainer 300. These one or more extension portions 327, where present, may function to provide additional lens retention within the luminaire. For example, the one or more extension portions 327 may be particularly advantageous, when used, where the luminaire is to be placed in a location with adversely low ambient temperature, which may cause the lens to physically shrink to a length that falls below the specified dimension.

Positioned proximate the first and second frame ends 315, 320 may be one or more spring levers 340, 345. In the illustrated embodiment, two spring levers 340, 345 are positioned on a scaffold 335 affixed to the rear face 307 of the lens retainer 300. In other embodiments, the one or more spring levers may be affixed or positioned directly on the rear face 307 of the lens retainer 300. Although illustrated in FIGS. 3-5 as having two spring levers 340, 345, in some embodiments the lens retainer 300 may only have a single spring lever. Each spring lever 340, 345 may be biased toward an opposing end of a luminaire when the lens retainer 300 is installed. The spring levers 340, 345 may be shaped and configured so as to receive and/or abut an elongate lens.

In some embodiments, an elongate lens, when installed, may be flush against the lens retainer 300, such that there is no gap between the lens and the lens retainer 300. Therefore, in some embodiments, the lens retainer 300 may take on a shape that mirrors that of the lens; for example, where the elongate lens is semi-circular or cylindrical in shape (as illustrated in FIGS. 1A, 1B, and 2), the lens retainer 300 may be similarly curved. This similar curvature may facilitate the prevention of gaps between the lens and the lens retainer 300 when installed. In some embodiments, the lens retainer 300 may be molded (e.g. injection molded) as a part of the luminaire body. While, in other embodiments, the lens retainer 300 may be a separate, snap on/off removable piece.

In embodiments where the lens retainer 300 is a separate, snap on/off removable piece, the lens retainer 300 may further include a mounting spring clip 350 that allows the lens retainer 300 to snap into a corresponding receiving portion on an end of a luminaire. In some embodiments, such as illustrated in FIGS. 3-5, the mounting spring clip 350 may be molded as a part of or attached to a scaffold 335 affixed to the rear face 307 of the lens retainer 300; however, this is not intended to be limiting, as in other embodiments the mounting spring clip 350 may be affixed to or molded as a part of the rear face 307 of the lens retainer 300. Such a mounting spring clip 350, where present, may facilitate holding the lens retainer 300 firmly in place in the luminaire.

In other embodiments, the ends 315, 320 of the lens retainer 300 are non-orthogonal and substantially match the slop surfaces of the luminaire (e.g. 115 and 120 of FIGS. 1A-B and 2). The non-orthogonal ends 315, 320 are used to forcibly hold the lens retainer 300 and an elongated lens (e.g. 135 of FIGS. 1B and 2) substantially along the center elongated axis of the luminaire, using sloped surfaces and end plates of the luminaire, such that additional affixing means, screws, or the like are not needed. Advantageously, the invention utilizes the internal reverse slope surfaces (115, 120) and end plates of the luminaire in conjunction with the lens retainer 300 to keep the lens retainer 300 from falling away from the luminaire.

Additionally, the lens retainer 300 may be opaque and not allow significant light transmission through the frame 310. In some embodiments, no light may be transmitted through the lens retainer 300 at all, as measured by an opacity test. In order to achieve a desired opacity, the lens retainer 300 may be constructed of acrylonitrile butadiene styrene plastic. However, this is not to be understood to be limiting, as the lens retainer 300 may also be constructed of other polymers, metal, etc.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

The invention claimed is:

1. A luminaire comprising:

a body, including first and second surfaces that define an elongate interior cavity between the first and second surfaces, the elongate interior cavity being sized to receive one or more elongate light sources;

an elongate lens that is removably securable to the body to at least partially cover the elongate interior cavity; and at least one lens retainer disposed at a first end of the elongate interior cavity, wherein the lens retainer includes:

a frame including a first frame end and a second frame end, at least a first spring lever disposed between the first and second frame ends, wherein the at least first spring lever is biased towards a second end of the elongate interior cavity that is opposite the first end of the elongate interior cavity;

wherein the elongate lens is snugly retainable on the body using the bias provided by the spring lever;

wherein the first frame end and the second frame end forcibly hold the lens retainer and the elongate lens along a center elongated axis of the luminaire using the first and the second surfaces and end plates of the luminaire, wherein the first and second surfaces are sloped and wherein the at least one lens retainer further includes a spring clip protruding along an axis that divides the lens retainer in half at a midpoint of the frame between the first and second frame ends, wherein the spring clip is configured to couple with a corresponding receiving portion of the luminaire.

2. The luminaire of claim 1, further comprising a driver for receiving an alternating current input and providing a direct current output for the elongate light source.

3. The luminaire of claim 1, wherein the lens retainer further includes an interior perimeter surface facing the elongate interior cavity, wherein the interior perimeter surface extends further into the elongate interior cavity at the first frame end and the second frame ends.

4. The luminaire of claim 3, wherein the interior perimeter surface is extended further into the elongate interior cavity at the first and the second frame ends by about one quarter inch.

5. The luminaire of claim 1, further comprising a second lens retainer disposed at the second end of the elongate interior cavity, wherein the second lens retainer includes:

a frame including a first frame end and a second frame end; and at least a first spring lever disposed between the first and second frame ends, wherein the at least first spring lever is biased towards the second end of the elongate interior cavity.

6. The luminaire of claim 5, wherein both the at least one lens retainer and the second lens retainer each further include an interior perimeter surface facing the elongate interior cavity, wherein the interior perimeter surface extends further into the elongate interior cavity at the first frame end and the second frame ends.

7. The luminaire of claim 6, wherein the interior perimeter surfaces of the at least one lens retainer and the second lens retainer extend further into the elongate interior cavity at the first frame end and the second frame ends by about one quarter inch.

8. The luminaire of claim 1, wherein each of the first and the second frame end further includes a flat, substantial triangular-shaped end piece.

9. The luminaire of claim 1, wherein the at least one lens retainer is opaque.

10. The luminaire of claim 1, wherein the luminaire comprises:

a first lens retainer disposed at a first end of the elongate interior cavity wherein the first lens retainer includes:

a first lens retainer frame including a first frame end and a second frame end, a first and a second spring lever each disposed between the first and second frame ends of the first lens retainer, wherein the first and the second spring levers are biased towards a second end of the elongate interior cavity that is opposite the first end of the elongate interior cavity;

a second lens retainer disposed at the second end of the elongate interior cavity wherein the second lens retainer includes:

a second lens retainer frame including a first frame end and a second frame end, a third and a fourth spring lever each disposed between the first and second frame ends of the second lens retainer frame, wherein the third and the fourth spring levers are biased towards the first end of the elongate interior cavity that is opposite the second end of the elongate interior cavity;

wherein the elongate lens is snugly retainable on the body using the bias provided by the first, second, third, and fourth spring levers; and wherein the first frame end and the second frame end forcibly hold the first and second lens retainer and the elongate lens along the center elongated axis of the luminaire using the first and the second surfaces and end plates of the luminaire.

11. The luminaire of claim 10, wherein each of the first the second lens retainers further include an interior perimeter surface facing the elongate interior cavity, wherein the interior perimeter surface extends further into the elongate interior cavity at the first and second frame ends.

12. The luminaire of claim 11, wherein the interior perimeter surfaces of the first and the second lens retainers extend further into the elongate interior cavity at the first frame end and the second frame ends by about one quarter inch.

13. A lens retainer configured for use in a luminaire, comprising:

a frame including a first frame end and a second frame end;

a first and a second spring lever each disposed between the first and second frame ends, wherein the first and the second spring levers are biased towards an elongate interior cavity of the luminaire;

wherein the lens retainer is configured to snugly retain an elongate lens of the luminaire using the bias provided by the first and second spring levers;

wherein the first frame end and the second frame end forcibly hold the lens retainer and the elongate lens along a center elongated axis of the luminaire using a first and the second surfaces and end plates of the luminaire, wherein the first and second surfaces are sloped and wherein the lens retainer further includes a spring clip protruding along an axis that divides the lens retainer in half at a midpoint of the frame between the first and second frame ends, wherein the spring clip is configured to couple with a corresponding receiving portion of the luminaire.

* * * * *